US007150209B1

(12) United States Patent
Loomis et al.

(10) Patent No.: US 7,150,209 B1
(45) Date of Patent: Dec. 19, 2006

(54) MULTI-FUNCTIONAL HEXAGONAL DRIVER

(76) Inventors: Larry A. Loomis, P.O. Box 652, Wister, OK (US) 74966; Thomas E. Evans, P.O. Box 503, Poteau, OK (US) 74953

( * ) Notice: Subject to any disclaimer, the term of this patent is extended or adjusted under 35 U.S.C. 154(b) by 112 days.

(21) Appl. No.: 10/969,639

(22) Filed: Oct. 21, 2004

(51) Int. Cl.
*B25B 13/00* (2006.01)
*B25B 13/58* (2006.01)

(52) U.S. Cl. ..... 81/124.5; 81/185

(58) Field of Classification Search ..... 81/124.5, 81/437, 185, 439, 177.85, 58.1
See application file for complete search history.

(56) References Cited

U.S. PATENT DOCUMENTS

| | | | | | |
|---|---|---|---|---|---|
| 957,778 | A * | 5/1910 | Lawrence | 81/185 |
| 1,270,263 | A * | 6/1918 | Burnson | 81/185 |
| 1,896,949 | A | 2/1933 | Greiner | |
| 2,735,325 | A * | 2/1956 | Rudd, Sr. | 81/439 |
| 3,127,798 | A * | 4/1964 | Gol | 81/439 |
| 3,233,482 | A | 2/1966 | Jaehne | |
| 4,528,875 | A * | 7/1985 | Hurst et al. | 81/185 |
| 4,541,314 | A * | 9/1985 | Korkowski | 81/58.1 |
| 4,882,958 | A | 11/1989 | McNeeley | |
| 5,287,778 | A | 2/1994 | Cook | |
| D394,993 | S | 6/1998 | Ashby | |
| 5,943,924 | A | 8/1999 | Jarvis | |
| 6,269,717 | B1 | 8/2001 | Bollinger | |
| 6,330,844 | B1 * | 12/2001 | Walker | 81/439 |
| 6,732,615 | B1 * | 5/2004 | Layaou | 81/124.5 |

* cited by examiner

*Primary Examiner*—Hadi Shakeri

(57) ABSTRACT

A multifunctional hexagonal driver includes a driver section that has a plurality of unique driver heads having various sizes for engaging fasteners. The driver further includes a mechanism for securing the driver heads to the housing and a mechanism for adapting the driver heads between extended and retracted positions. A handle section has a bore formed therein for effectively receiving the driver section therein. Such a handle section includes a sleeve slidably positionable thereover and an elongated socket formed at a proximal end portion of the handle section. The socket includes a ball bearing extending radially and inwardly therefrom.

12 Claims, 4 Drawing Sheets

MULTI-FUNCTIONAL HEXAGONAL DRIVER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a hexagonal driver and, more particularly, to a multifunctional hexagonal driver including a ratcheting mechanism.

2. Prior Art

Socket wrenches, including a drive tool and socket, are commonly used to turn fasteners, such as nuts and bolts. A first end of the socket is placed over the bolt and the drive tool is inserted into a second socket end. A user then applies force directly to the drive tool for rotating the bolt.

A standard socket set includes a number of sockets each having different first end sizes for accommodating a variety of sizes of bolt heads and other like fasteners. Commonly, the sockets are dimensioned according to the common sizes of fasteners, such as the metric or English systems. The second socket end attaches to the drive tool and may have a variety of sizes, depending upon the manufacturer, year of manufacture, first socket end dimensions, and the like. Each of the second ends is substantially rectangular in shape, but there are no standardized sizes or dimensions. Regardless, all these components, including the sockets themselves and the socket wrench, consume a considerable amount of space within an individual's work area.

Furthermore, a lot of time can be wasted in trying to figure out which socket must be used on a particular hexagonal nut or bolt and then fitting the correct socket onto the wrench. This results in loss of productivity for individuals using the conventional socket wrench at their workstation or wherever they may be performing their task. With a large number of loose sockets it is also possible to easily drop and loose a particular sized socket as the individual is performing their task, thus resulting in the necessity to replace the lost socket which can be expensive in the long run.

Accordingly, a need remains for a multi-functional hexagonal driver in order to overcome the above-noted shortcomings. The present invention satisfies such a need by providing a driver that has a convenient multi-function design, is portable and easy to store, cost-effective, and results in considerable time savings when used. Such a wrench eliminates the need to switch between drivers, saving time and improving productivity. The present invention will be appreciated by professional trades-people as well as do-it-yourselfers.

BRIEF SUMMARY OF THE INVENTION

In view of the foregoing background, it is therefore an object of the present invention to provide a multifunctional hexagonal driver. These and other objects, features, and advantages of the invention are provided by an apparatus for tightening and loosening various sized fasteners. The apparatus includes a driver section formed from rigid material that has a centrally disposed bore provided with a longitudinal axis extending along a partial length of the apparatus.

The driver section includes a plurality of unique driver heads having various sizes for engaging the fasteners during operating conditions. Such driver heads are radially spaced about the axis and maintain a concentric relationship when adapted between extended and retracted positions. Advantageously, the plurality of driver heads are removably positionable within the bore so that a user can selectively access alternate ones of the driver heads as desired.

The driver includes a mechanism for securing the driver heads to the housing and a mechanism for adapting the driver heads between extended and retracted positions. Such a securing mechanism preferably includes a plurality of fingers integrally extending from the driver heads. The housing is provided with a plurality of notches for receiving the fingers therein and for advantageously maintaining the driver heads at a substantially stable position during operating conditions. The adapting mechanism preferably includes a plurality of resilient springs operably connected to the driver heads and disposed distally of the sleeve. Such springs are compressed and relaxed when the driver heads are toggled between corresponding retracted and extended positions.

A handle section having a bore formed therein is included for effectively receiving the driver section therein. Such a handle section includes a sleeve slidably positionable thereover for providing a convenient gripping surface onto which a user may grasp the apparatus. An elongated socket is formed at a proximal end portion of the handle section and extends distally along the axis such that an auxiliary driver can be removably secured thereto. The auxiliary driver can rotate select ones of the driver heads without requiring a user to maintain contact about the sleeve. The socket includes a ball bearing extending radially and inwardly therefrom. The sleeve preferably includes an outer layer formed from rubber material for conveniently providing frictional support.

The apparatus may further include a locking mechanism for conveniently toggling the handle section between stationary and rotatable positions so that a user can operate the apparatus in a ratcheting manner. The locking mechanism preferably includes a switch situated on an outer surface of the handle section including an arm extending downwardly into the handle section and a toothed gear disposed about the axis and subjacent to the arm wherein the gear is axially rotatable between selected directions when the switch is moved to a predetermined position. Such a gear is slidably engageable with the arm when the switch is moved to a predetermined position and the gear is stationary and abutted with the arm when the switch is moved to an alternate position. The locking mechanism may further include a spring steel member having opposed end portions secured to the handle section and the arm respectively.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
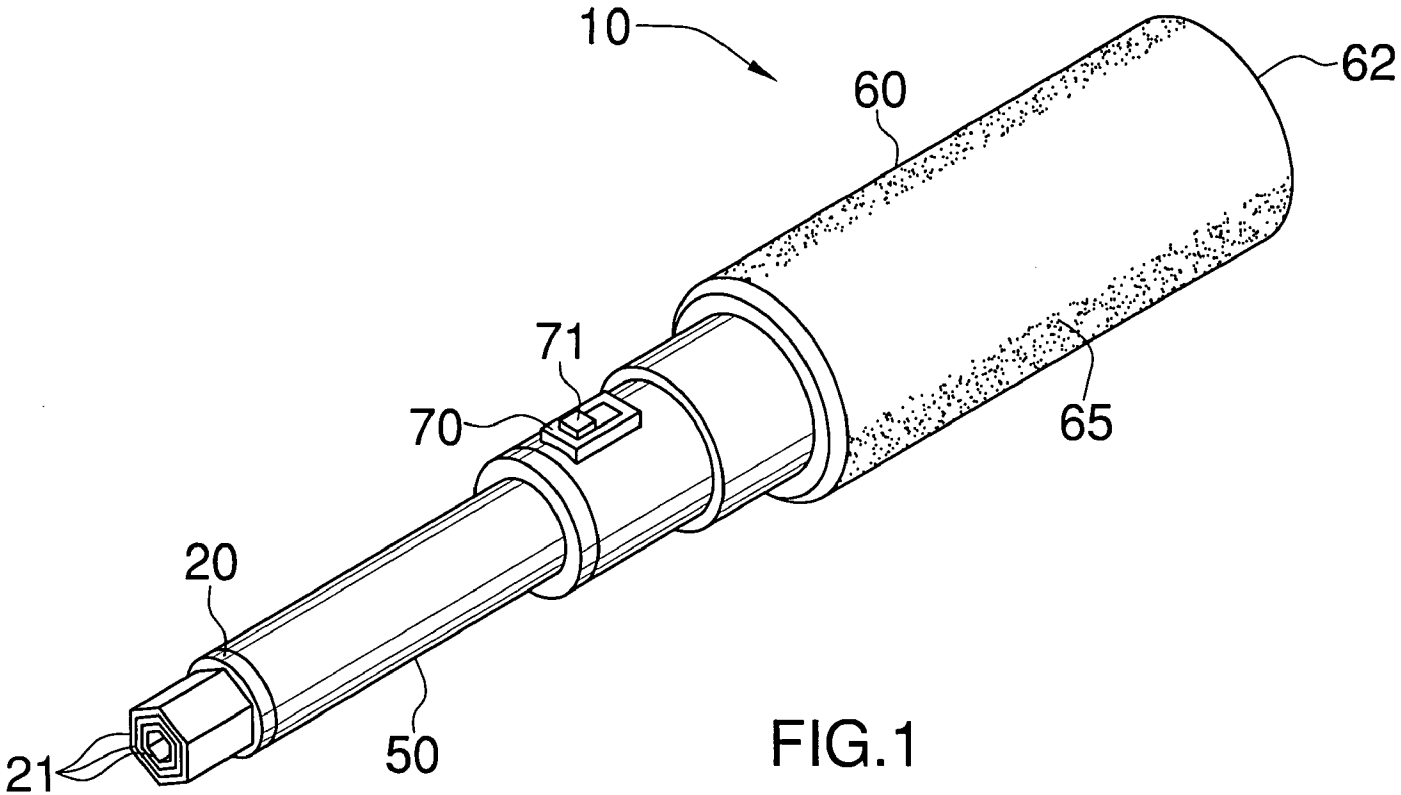
FIG. 1 is a perspective view showing a multi-functional hexagonal driver for tightening and loosening various sized fasteners, in accordance with the present invention.
Figure 2:
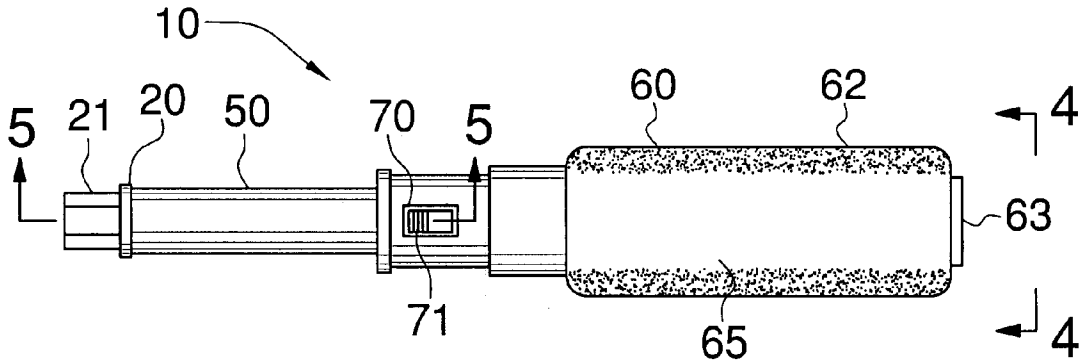
FIG. 2 is a side elevational view of the apparatus shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–8 by the reference numeral 10 and is intended to provide a multi-functional hexagonal driver. It should be understood that the apparatus 10 may be used to fasten many different types of objects and should not be limited to only hexagonal bolts.

Referring initially to FIG. 1, the apparatus 10 includes a driver section 20 formed from rigid material that has a centrally disposed bore provided with a longitudinal axis extending along a partial length of the apparatus 10.

Figure 3:
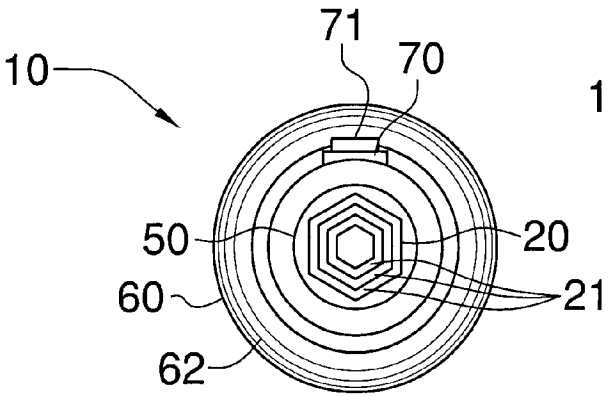
FIG. 3 is an enlarged front elevational view of the apparatus shown in FIG. 1.

Referring to FIGS. 1 and 3, the driver section 20 includes a plurality of unique driver heads 21 having various sizes for engaging the fasteners (not shown) during operating conditions. Such driver heads 21 are radially spaced about the axis and maintain a concentric relationship when adapted between extended and retracted positions. Advantageously, the plurality of driver heads 21 are movably positionable within the bore 90 so that a user can selectively access alternate ones of the driver heads 21 as desired. This feature conveniently eliminates the need to intermittently cease work in order to obtain an alternate driver head 21, thus saving the user time.

Figure 5:
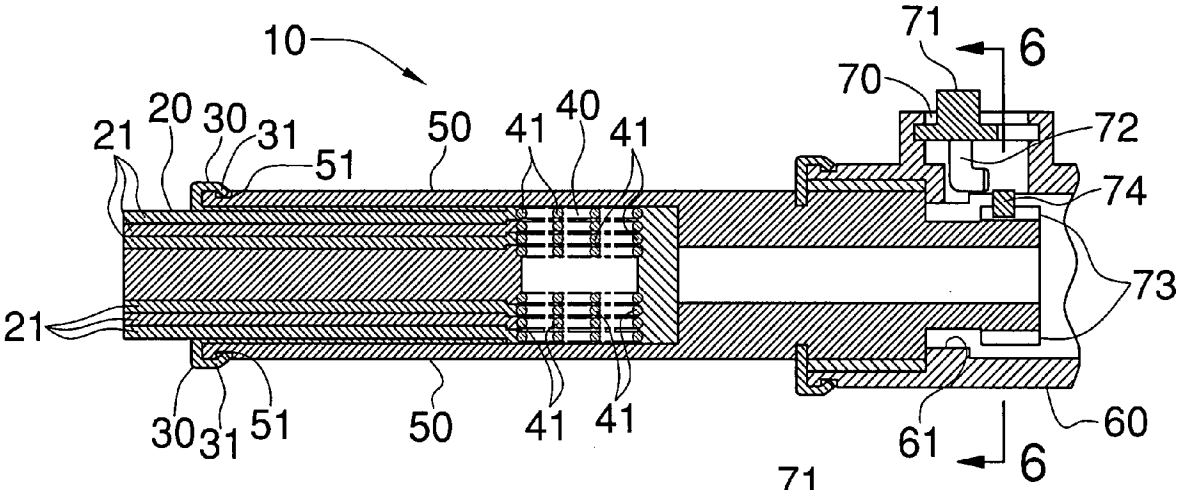
FIG. 5 is an enlarged cross-sectional view of the apparatus shown in FIG. 2, taken along line 5—5.
Figure 6:
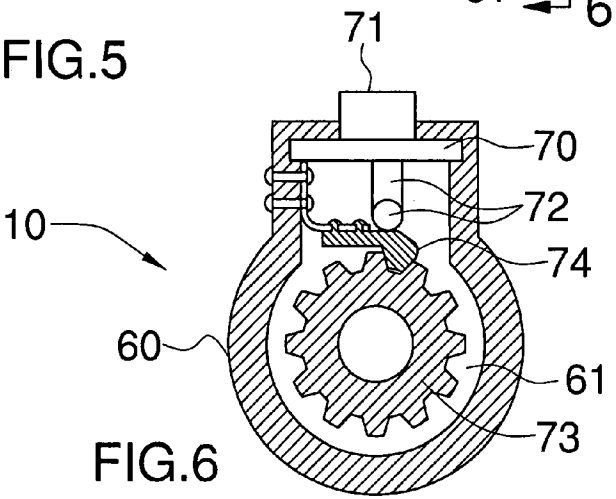
FIG. 6 is a cross-sectional view of the apparatus shown in FIG. 5, taken along line 6—6.

Referring to FIG. 5, the driver 10 includes a mechanism 30 for securing the driver heads 21 to the housing 50 and a mechanism 40 for adapting the driver heads 21 between extended and retracted positions. Such a securing mechanism 30 includes a plurality of fingers 31 integrally extending from the driver heads 21. The housing 50 is provided with a plurality of notches 51 for receiving the fingers 31 therein and for advantageously maintaining the driver heads 21 at a substantially stable position during operating conditions.

Advantageously, this feature prevents the driver heads 21 from slipping about the fasteners, which is a common problem with conventional drivers. The adapting mechanism 40 includes a plurality of resilient springs 41 operably connected to the driver heads 21 and disposed distally of the sleeve 62 (described herein below). Such springs 41 are compressed and relaxed when the driver heads 21 are toggled between corresponding retracted and extended positions.

Figure 4:
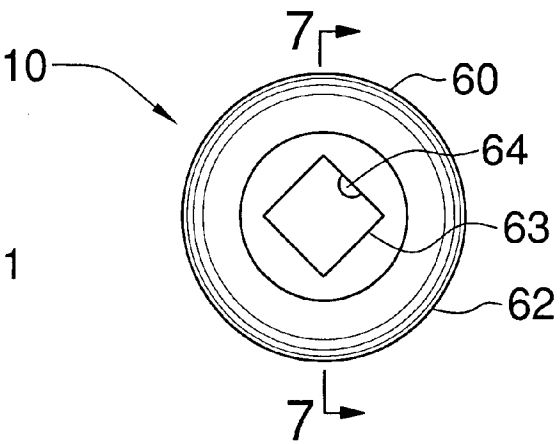
FIG. 4 is an enlarged rear elevational view of the apparatus shown in FIG.
Figure 7:
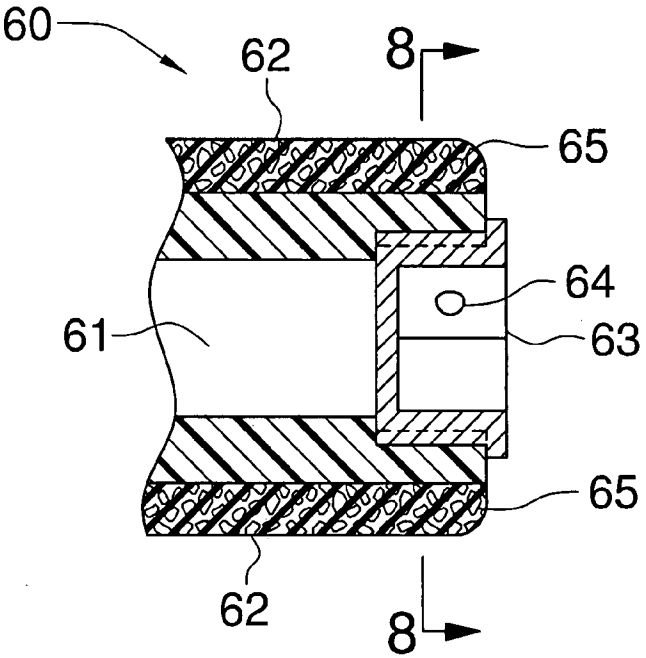
FIG. 7 is an enlarged cross-sectional view of the apparatus shown in FIG. 4, taken along line 7—7.
Figure 8:
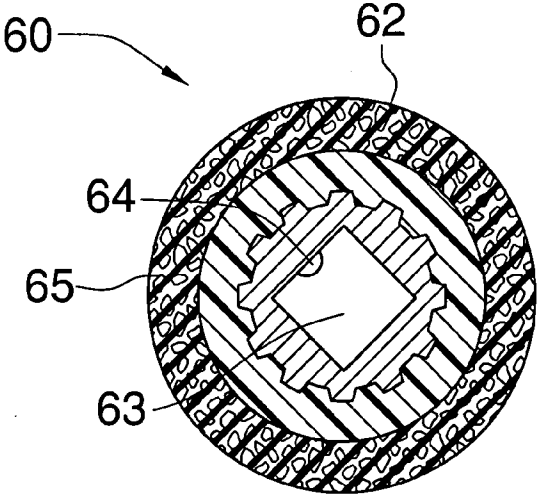
FIG. 8 is a cross-sectional view of the apparatus shown in FIG. 7.

Referring to FIGS. 4, 7 and 8, a handle section 60 is included having a bore 61 formed therein for effectively receiving the driver section 20 therein. Such a handle section 60 includes a sleeve 62 slidably positionable thereover for providing a convenient gripping surface onto which a user may grasp the apparatus 10. An elongated socket 63 is formed at a proximal end portion of the handle section 60 and extends distally along the axis such that an auxiliary driver can be removably secured thereto. Such an auxiliary driver can rotate select ones of the driver heads 21 without requiring a user to maintain contact about the sleeve 62. This feature conveniently allows the apparatus 10 to be extended into areas where it would not otherwise be able to reach, improving the usefulness thereof.

The socket 63 includes a ball bearing 64 extending radially and inwardly therefrom. The sleeve 62 includes an outer layer 65 formed from rubber material for conveniently providing frictional support. Such an outer layer 65 advantageously prevents the apparatus 10 from slipping out of the user's hand, thereby preventing the apparatus 10 from being damage.

Referring to FIGS. 1, 2, 5 and 6, the apparatus 10 further includes a locking mechanism 70 for conveniently toggling the handle section 60 between stationary and rotatable positions so that a user can operate the apparatus 10 in a ratcheting manner, thereby increasing the versatility of the apparatus 10. Such a locking mechanism 70 includes a switch 71 situated on an outer surface of the handle section 60 including an arm 72 extending downwardly into the handle section 60 and a toothed gear 73 disposed about the axis and subjacent to the arm 72 wherein the gear 73 is axially rotatable between selected directions when the switch 71 is moved to a predetermined position. The gear 73 is slidably engageable with the arm 72 when the switch 71 is moved to a predetermined position and the gear 73 is stationary and abutted with the arm 72 when the switch 71 is moved to an alternate position. The locking mechanism 70 further includes a spring steel member 74 having opposed end portions secured to the handle section 60 and the arm 72 respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An apparatus for tightening and loosening various sized fasteners, said apparatus comprising:

a driver section having a centrally disposed bore provided with a longitudinal axis extending along a partial length of said apparatus, said driver section comprising a plurality of unique driver heads for engaging the fasteners during operating conditions, said driver heads being radially spaced about the axis and maintaining a concentric relationship when adapted between extended and retracted positions, said plurality of driver heads being movably positionable within the bore so that a user can selectively access alternate ones of said driver heads as desired, means for securing said driver heads to a housing, and means for adapting said driver heads between the extended and retracted positions; and a handle section having a bore formed therein for receiving said driver section therein, said handle section comprising a sleeve slidably positionable thereover for providing a gripping surface onto which a user may grasp said apparatus, and a socket formed at a proximal end portion of said handle section such that an auxiliary driver can be removably secured thereto and rotate select ones of said driver heads without requiring a user to maintain contact about said sleeve; and locking means for toggling said handle section between stationary and rotatable positions so that a user can operate said apparatus in a ratcheting manner, wherein said locking means comprises a switch situated on an outer surface of said handle section, said switch including an arm extending downwardly into said handle section;

a toothed gear disposed about the axis and subjacent said arm, said gear being slidably engageable with said arm when said switch is moved to a predetermined position; and a spring steel member having opposed end portions secured to said handle section and said arm respectively;

wherein said gear is axially rotatable between selected directions when said switch is moved to the predetermined position, said gear being stationary and abutted with said arm when said switch is moved to an alternate position.

2. The apparatus of claim 1, wherein said securing means comprises:

a plurality of fingers integrally extending from said driver heads, said housing being provided with a plurality of notches for receiving said fingers therein and for maintaining said driver heads at a substantially stable position during operating conditions.

3. The apparatus of claim 1, wherein said adapting means comprises:

a plurality of resilient springs operably connected to said driver heads and disposed distally of said sleeve, said springs being compressed and relaxed when said driver heads are toggled between corresponding retracted and extended positions.

4. The apparatus of claim 1, wherein said sleeve comprises: an outer layer formed from rubber material for providing frictional support.

5. An apparatus for tightening and loosening various sized fasteners, said apparatus comprising:

a driver section having a centrally disposed bore provided with a longitudinal axis extending along a partial length of said apparatus, said driver section comprising a plurality of unique driver heads having various sizes for engaging the fasteners during operating conditions, said driver heads being radially spaced about the axis and maintaining a concentric relationship when adapted between extended and retracted positions, said plurality of driver heads being movably positionable within the bore so that a user can selectively access alternate ones of said driver heads as desired, means for securing said driver heads to a housing, and means for adapting said driver heads between the extended and retracted positions; and a handle section having a bore formed therein for receiving said driver section therein, said handle section comprising a sleeve slidably positionable thereover for providing a gripping surface onto which a user may grasp said apparatus, and a socket formed at a proximal end portion of said handle section such that an auxiliary driver can be removably secured thereto and rotate select ones of said driver heads without requiring a user to maintain contact about said sleeve, said socket including a ball bearing extending radially and inwardly therefrom; and locking means for toggling said handle section between stationary and rotatable positions so that a user can operate said apparatus in a ratcheting manner, wherein said locking means comprises a switch situated on an outer surface of said handle section, said switch including an arm extending downwardly into said handle section;

a toothed gear disposed about the axis and subjacent said arm, said gear being slidably engageable with said arm when said switch is moved to a predetermined position; and a spring steel member having opposed end portions secured to said handle section and said arm respectively;

wherein said gear is axially rotatable between selected directions when said switch is moved to the predetermined position, said gear being stationary and abutted with said arm when said switch is moved to an alternate position.

6. The apparatus of claim 5, wherein said securing means comprises:

a plurality of fingers integrally extending from said driver heads, said housing being provided with a plurality of notches for receiving said fingers therein and for maintaining said driver heads at a substantially stable position during operating conditions.

7. The apparatus of claim 5, wherein said adapting means comprises:

a plurality of resilient springs operably connected to said driver heads and disposed distally of said sleeve, said springs being compressed and relaxed when said driver heads are toggled between corresponding retracted and extended positions.

8. The apparatus of claim 5, wherein said sleeve comprises: an outer layer formed from rubber material for providing frictional support.

9. An apparatus for tightening and loosening various sized fasteners, said apparatus comprising:

a driver section formed from rigid material and having a centrally disposed bore provided with a longitudinal axis extending along a partial length of said apparatus, said driver section comprising a plurality of unique driver heads having various sizes for engaging the fasteners during operating conditions, said driver heads being radially spaced about the axis and maintaining a concentric relationship when adapted between extended and retracted positions, said plurality of driver heads being movably positionable within the bore so that a user can selectively access alternate ones of said driver heads as desired, means for securing said driver heads to a housing, and means for adapting said driver heads between the extended and retracted positions; and a handle section having a bore formed therein for receiving said driver section therein, said handle section comprising a sleeve slidably positionable thereover for providing a gripping surface onto which a user may grasp said apparatus, and an elongated socket formed at a proximal end portion of said handle section and extending distally along the axis such that an auxiliary driver can be removably secured thereto and rotate select ones of said driver heads without requiring a user to maintain contact about said sleeve, said socket including a ball bearing extending radially and inwardly therefrom, and locking means for toggling said handle section between stationary and rotatable positions so that a user can operate said apparatus in a ratcheting manner, wherein said locking means comprises a switch situated on an outer surface of said handle section, said switch including an arm extending downwardly into said handle section;

a toothed gear disposed about the axis and subjacent said arm, said gear being slidably engageable with said arm when said switch is moved to a predetermined position; and a spring steel member having opposed end portions secured to said handle section and said arm respectively;

wherein said gear is axially rotatable between selected directions when said switch is moved to the predetermined position, said gear being stationary and abutted with said arm when said switch is moved to an alternate position.

10. The apparatus of claim 9, wherein said securing means comprises:

a plurality of fingers integrally extending from said driver heads, said housing being provided with a plurality of notches for receiving said fingers therein and for maintaining said driver heads at a substantially stable position during operating conditions.

11. The apparatus of claim 9, wherein said adapting means comprises:

a plurality of resilient springs operably connected to said driver heads and disposed distally of said sleeve, said springs being compressed and relaxed when said driver heads are toggled between corresponding retracted and extended positions.

12. The apparatus of claim 9, wherein said sleeve comprises: an outer layer formed from rubber material for providing frictional support.

* * * * *